US011149493B2

(12) United States Patent
Boyer

(10) Patent No.: US 11,149,493 B2
(45) Date of Patent: Oct. 19, 2021

(54) FOLDABLE STEPLADDER

(71) Applicant: Dorel Home Furnishings, Inc., Wright City, MI (US)

(72) Inventor: Jason A. Boyer, Columbus, IN (US)

(73) Assignee: Dorel Home Furnishings, Inc., Wright City, MI (US)

( * ) Notice: Subject to any disclaimer, the term of this patent is extended or adjusted under 35 U.S.C. 154(b) by 192 days.

(21) Appl. No.: 16/396,111

(22) Filed: Apr. 26, 2019

(65) Prior Publication Data

US 2019/0330920 A1 Oct. 31, 2019

Related U.S. Application Data

(60) Provisional application No. 62/664,604, filed on Apr. 30, 2018, provisional application No. 62/767,141, filed on Nov. 14, 2018.

(51) Int. Cl.

| | |
|---|---|
| ***E06C 1/387*** | (2006.01) |
| ***E06C 7/06*** | (2006.01) |
| ***E06C 1/383*** | (2006.01) |
| ***E06C 7/50*** | (2006.01) |

(52) U.S. Cl.

CPC ..... *E06C 1/387* (2013.01); *E06C 1/383* (2013.01); *E06C 7/06* (2013.01); *E06C 7/50* (2013.01)

(58) Field of Classification Search

CPC ... A47C 12/00; E06C 1/00; E06C 1/14; E06C 1/16; E06C 1/20; E06C 1/383; E06C 1/387; E06C 1/39; E06C 7/50

See application file for complete search history.

(56) References Cited

U.S. PATENT DOCUMENTS

| | | | | |
|---|---|---|---|---|
| 3,127,953 | A * | 4/1964 | Shore | E06C 1/393 182/106 |
| 4,191,397 | A * | 3/1980 | Kassai | B62B 7/062 280/647 |
| 4,276,955 | A * | 7/1981 | Hickman | E06C 1/005 182/33 |
| 4,485,892 | A * | 12/1984 | Maloney | E06C 1/393 182/161 |
| 6,390,238 | B1 | 5/2002 | Gibson et al. | |
| 6,427,805 | B1 | 8/2002 | Gibson et al. | |
| 6,443,261 | B1 | 9/2002 | Gibson et al. | |
| 6,454,050 | B2 | 9/2002 | Gibson et al. | |
| 6,550,379 | B2 | 4/2003 | Chiu | |
| 6,991,248 | B2 * | 1/2006 | Valdez | B62B 7/062 280/647 |
| 7,100,739 | B2 | 9/2006 | Parker et al. | |
| 7,108,103 | B2 | 9/2006 | Meeker | |
| 7,182,176 | B2 | 2/2007 | Gibson et al. | |
| 7,296,820 | B2 * | 11/2007 | Valdez | B62B 7/062 280/647 |

(Continued)

FOREIGN PATENT DOCUMENTS

| | | | | |
|---|---|---|---|---|
| GB | 2029884 | A * | 3/1980 | E06C 1/39 |
| WO | WO-2007110888 | A1 * | 10/2007 | E06C 1/393 |

*Primary Examiner* — Colleen M Chavchavadze

(74) *Attorney, Agent, or Firm* — Barnes & Thornburg LLP

(57) ABSTRACT

A foldable stepladder in accordance with the present disclosure may be changed by a user from an expanded use mode to a collapsed storage mode. The foldable stepladder includes a handrail that moves to reduce the overall height of the stepladder when in the collapsed storage mode.

20 Claims, 16 Drawing Sheets

(56) References Cited

U.S. PATENT DOCUMENTS

| | | | | |
|---|---|---|---|---|
| 7,311,177 | B2 * | 12/2007 | Parker | A47C 12/00 182/163 |
| 7,383,920 | B2 | 6/2008 | Meeker | |
| D620,132 | S | 7/2010 | Han | |
| 7,931,123 | B2 | 4/2011 | Moldthan et al. | |
| 7,967,111 | B2 | 6/2011 | Meyers et al. | |
| 7,984,790 | B2 | 7/2011 | Meyers et al. | |
| 8,104,578 | B2 * | 1/2012 | Moldthan | E06C 1/387 182/129 |
| 8,127,890 | B2 * | 3/2012 | Meyers | E06C 1/397 182/21 |
| 8,341,806 | B2 * | 1/2013 | Parker | E06C 1/005 16/326 |
| 9,475,516 | B1 * | 10/2016 | Wang | B62B 7/062 |
| D797,955 | S | 9/2017 | Wilbur | |
| 10,167,668 | B1 * | 1/2019 | Wang | E06C 7/082 |
| 10,435,057 | B2 * | 10/2019 | Gorza | B62B 7/086 |
| 10,837,229 | B2 * | 11/2020 | Yoo | E06C 1/393 |
| 10,844,660 | B2 * | 11/2020 | Leng | E06C 1/22 |
| 10,876,356 | B2 * | 12/2020 | Russell | E06C 7/182 |

* cited by examiner

FOLDABLE STEPLADDER

PRIORITY CLAIM

This application claims priority under 35 U.S.C. § 119(e) to U.S. Provisional Application Ser. No. 62/664,604, filed Apr. 30, 2018, and U.S. Provisional Application Ser. No. 62/767,141, filed Nov. 14, 2018, which are both expressly incorporated by reference herein.

BACKGROUND

The present disclosure relates to a ladder, and particularly to a foldable stepladder. More particularly, the present disclosure relates to a foldable stepladder that can be collapsed to save storage space when the foldable stepladder is not in use.

SUMMARY

A foldable stepladder in accordance with the present disclosure may be changed by a user from an expanded use mode to a collapsed storage mode. The foldable stepladder includes a handrail that pivots relative to other components to reduce the overall height of the stepladder when in the collapsed storage mode.

In illustrative embodiments, the foldable stepladder includes a step unit having first and second rear legs and a relatively shorter step-stabilizer frame having first and second front legs. The handrail is pivotably coupled to the front legs of the step-stabilizer frame at a front-leg handrail pivot axis and to the rear legs of the step unit at rear-leg handrail pivot axis. The handrail pivots about the front-leg handrail pivot axis relative to the step-stabilizer frame during folding and unfolding of the stepladder to change the height of the stepladder.

In illustrative embodiments, the handrail of the foldable stepladder is U-shaped and includes first and second side rails interconnected by a grip handle. The rear-leg handrail pivot axis lies between the grip handle and the front-leg handrail pivot axis when the foldable stepladder is in either the expanded use mode or the collapsed storage mode.

In illustrative embodiments, the foldable stepladder includes two rear-leg lock units configured to be operated by a user to retain the stepladder in the expanded use mode. Each rear-leg lock unit is mounted on the pivotable handrail to pivot with the pivotable handrail relative to other components of the stepladder. Each rear-leg lock unit includes an anti-rotation element that can engage one of the rear legs the step unit when the stepladder is in the expanded use mode to block pivoting movement of the pivotable handrail about the front-leg and rear-leg handrail pivot axes, thereby fixing the stepladder in the expanded use mode. A user can release each rear-leg lock unit by pulling or pressing an actuator included in the rear-leg lock unit.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a foldable stepladder in an expanded use mode showing that the foldable stepladder includes a step unit having two steps, a relatively shorter step-stabilizer frame, and a pivotable handrail, and further showing that the handrail is pivotably coupled to front legs included in the step-stabilizer frame at a front-leg handrail pivot axis and to rear legs included in the step unit at a rear-leg handrail pivot axis;

Figure 7A:
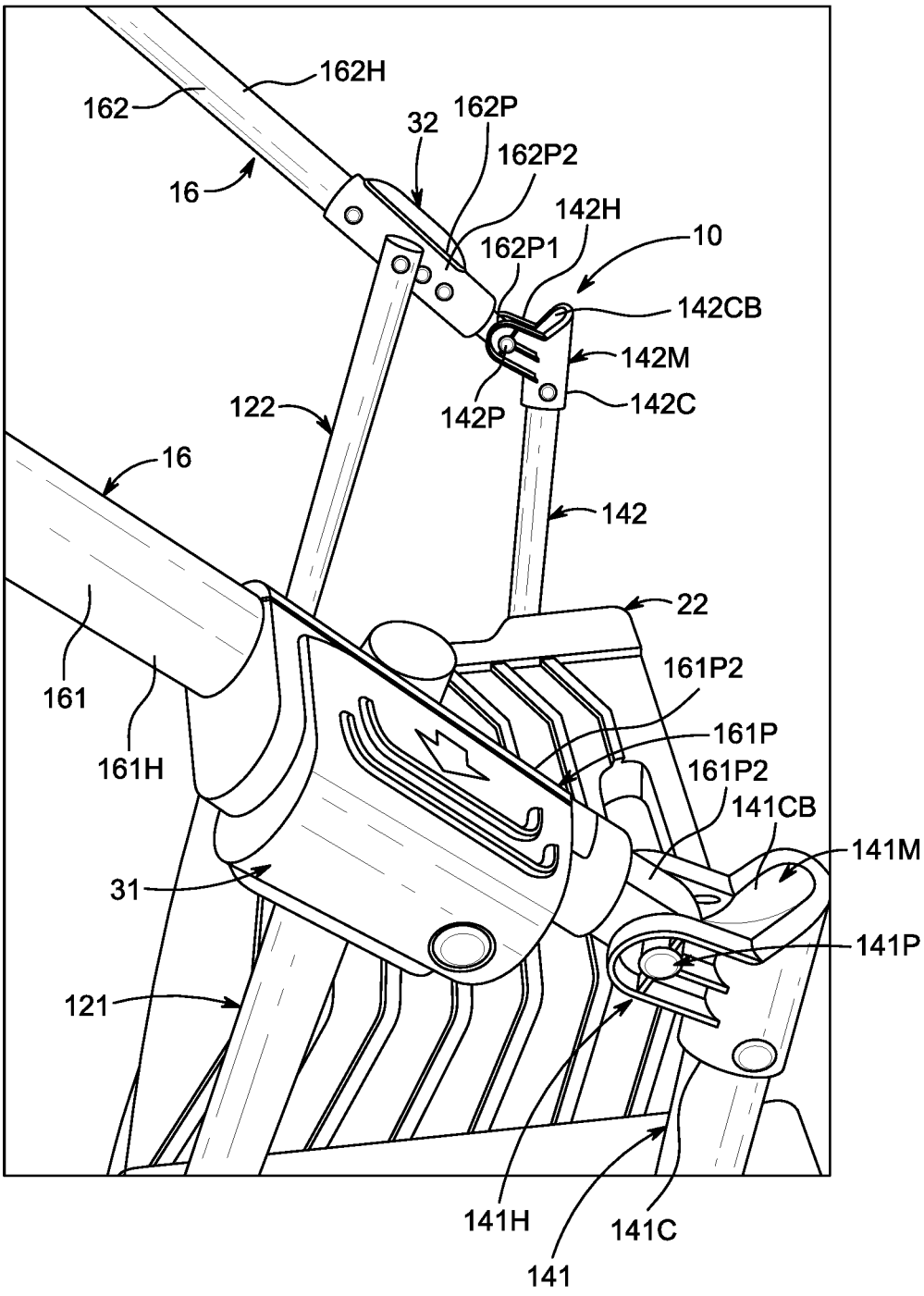
FIG. 7A is a perspective view of a portion of the foldable step ladder of FIG. 1 looking down upon the upper step of the step unit and showing a first side of the stepladder in the foreground and an opposite second side of the stepladder in the background.
Figure 7B:
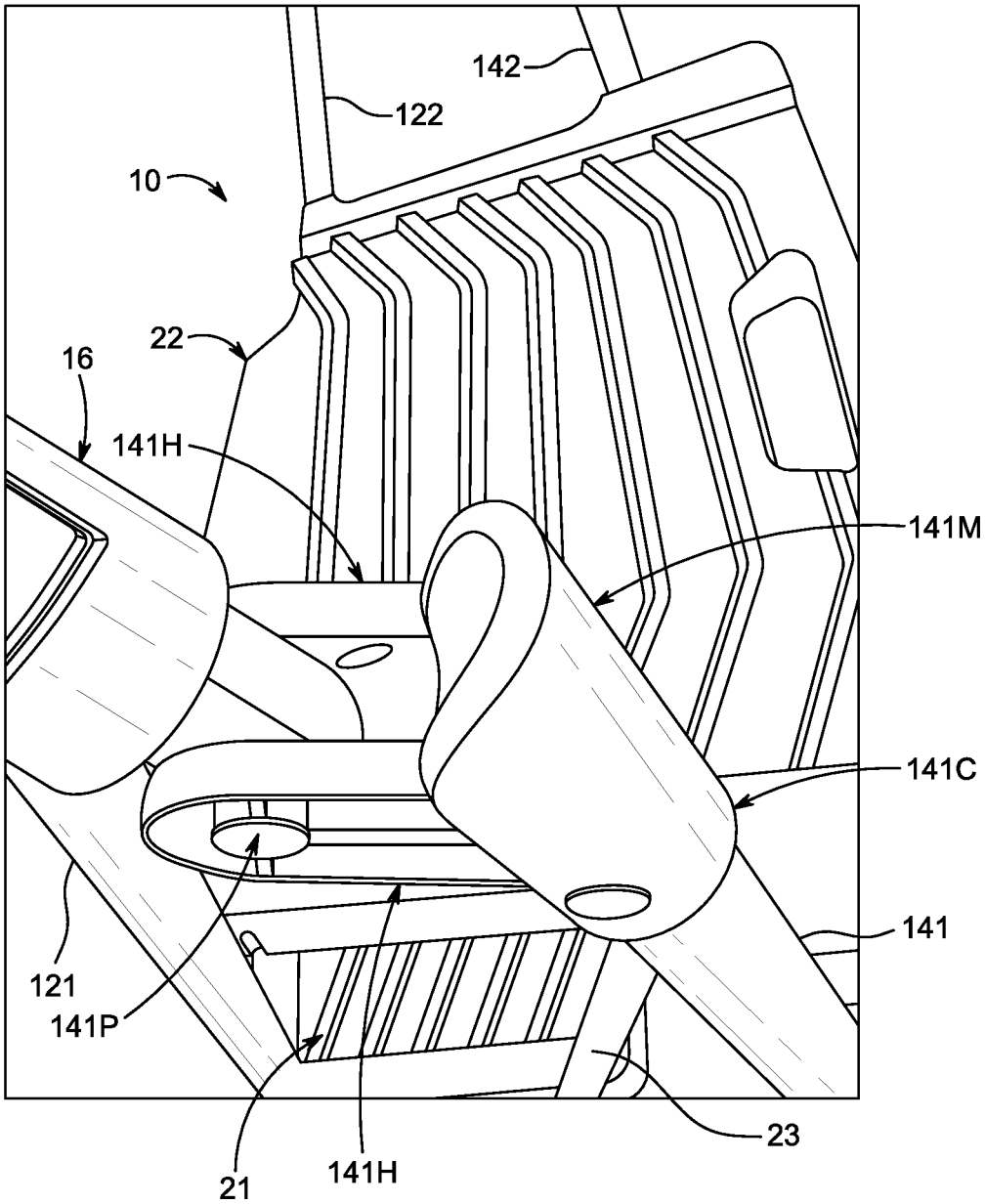
FIG. 7B is an enlarged perspective view of a portion of the first side of the stepladder of FIG. 7A showing pivotable engagement of an upper portion of a first side of the step-stabilizer frame with a lower portion of a first side of the pivotable handrail.
Figure 7C:
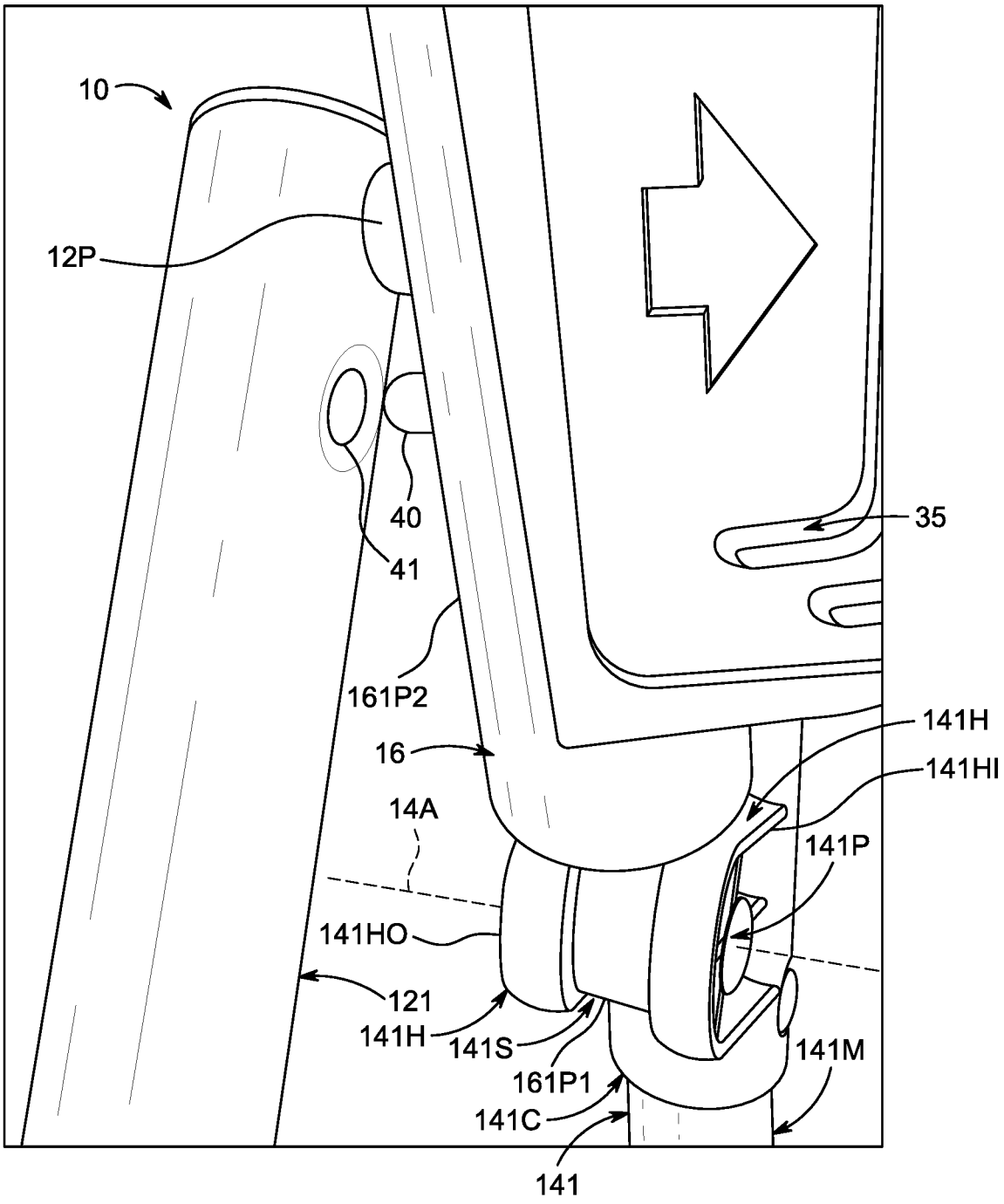
Figure 8A:
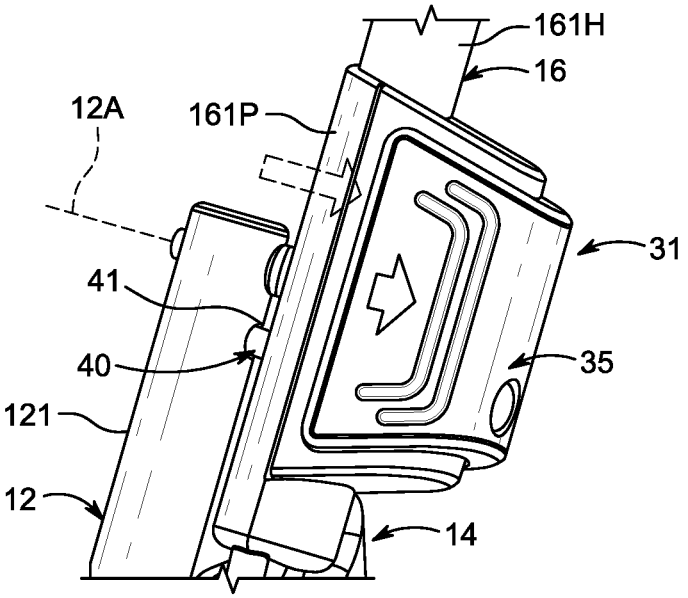
Figure 8B:
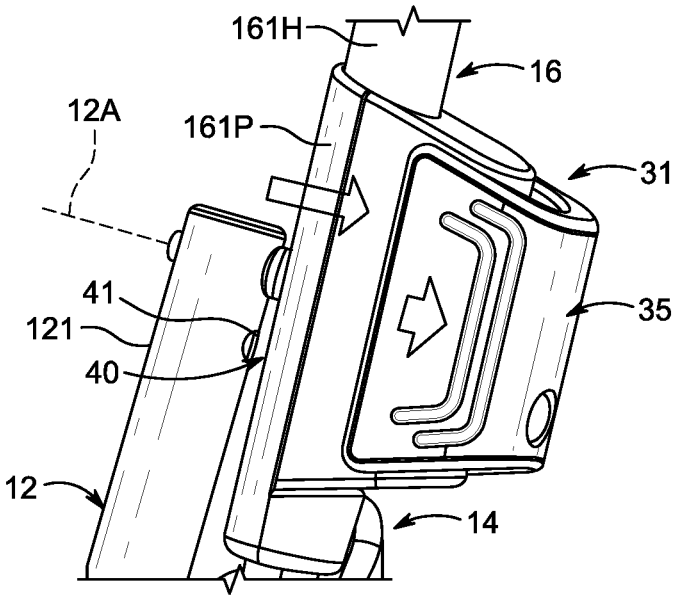
Figure 9:
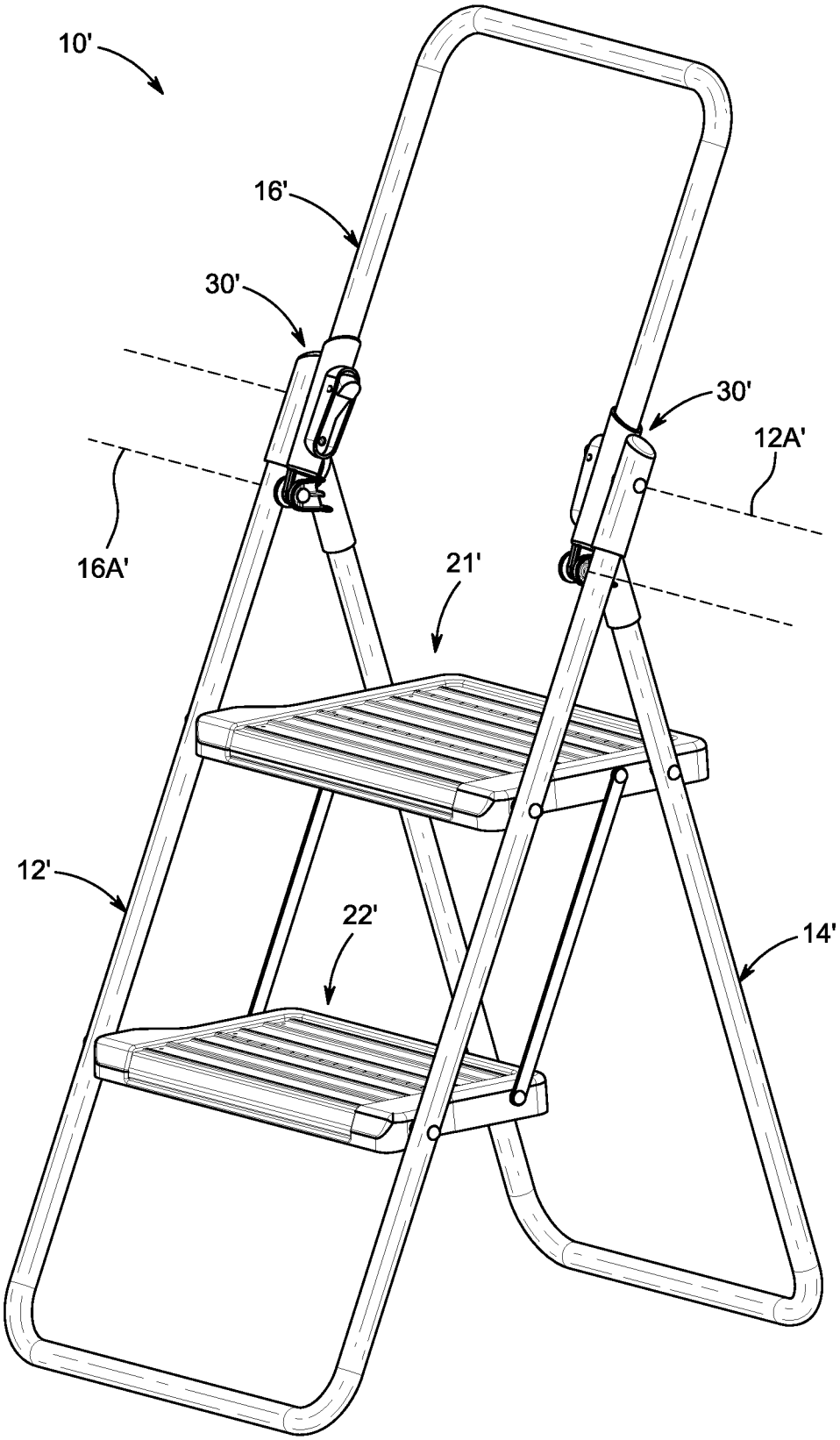
Figure 10:
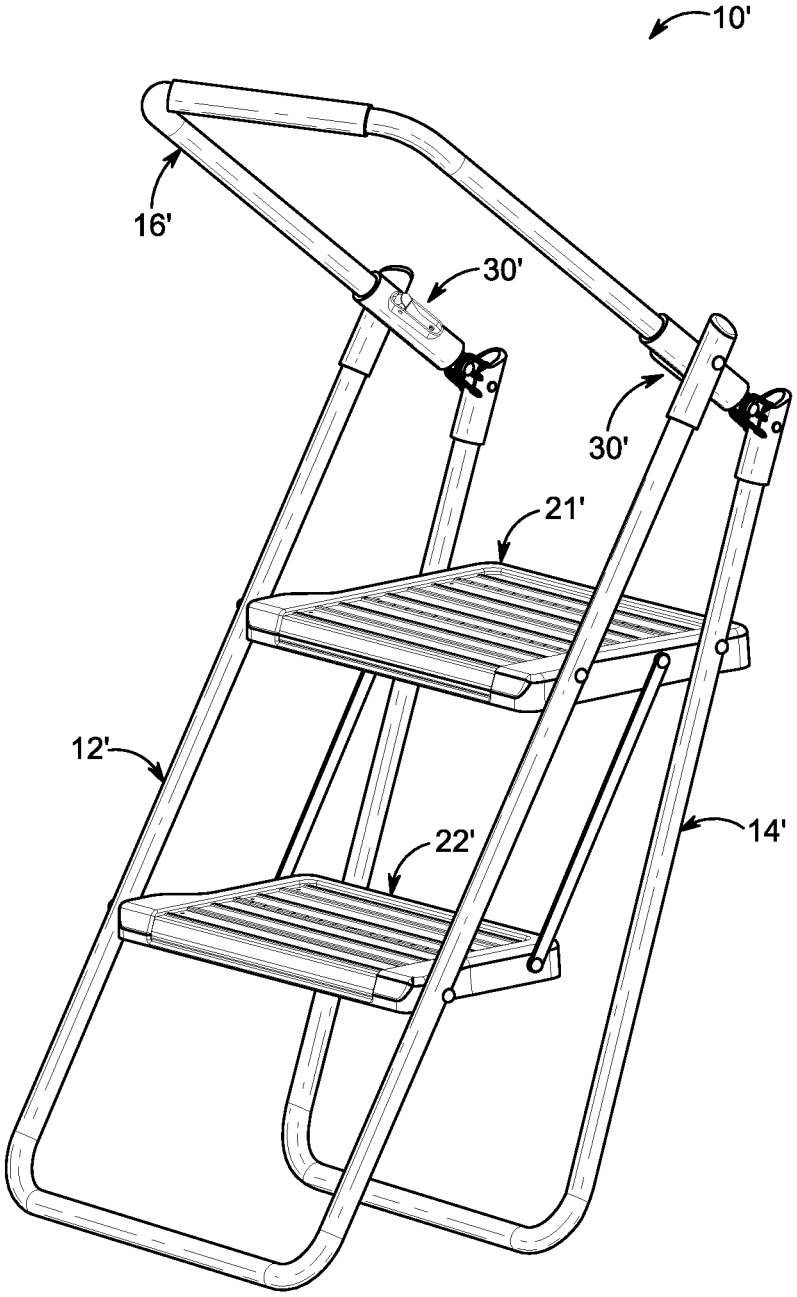
Figure 11:
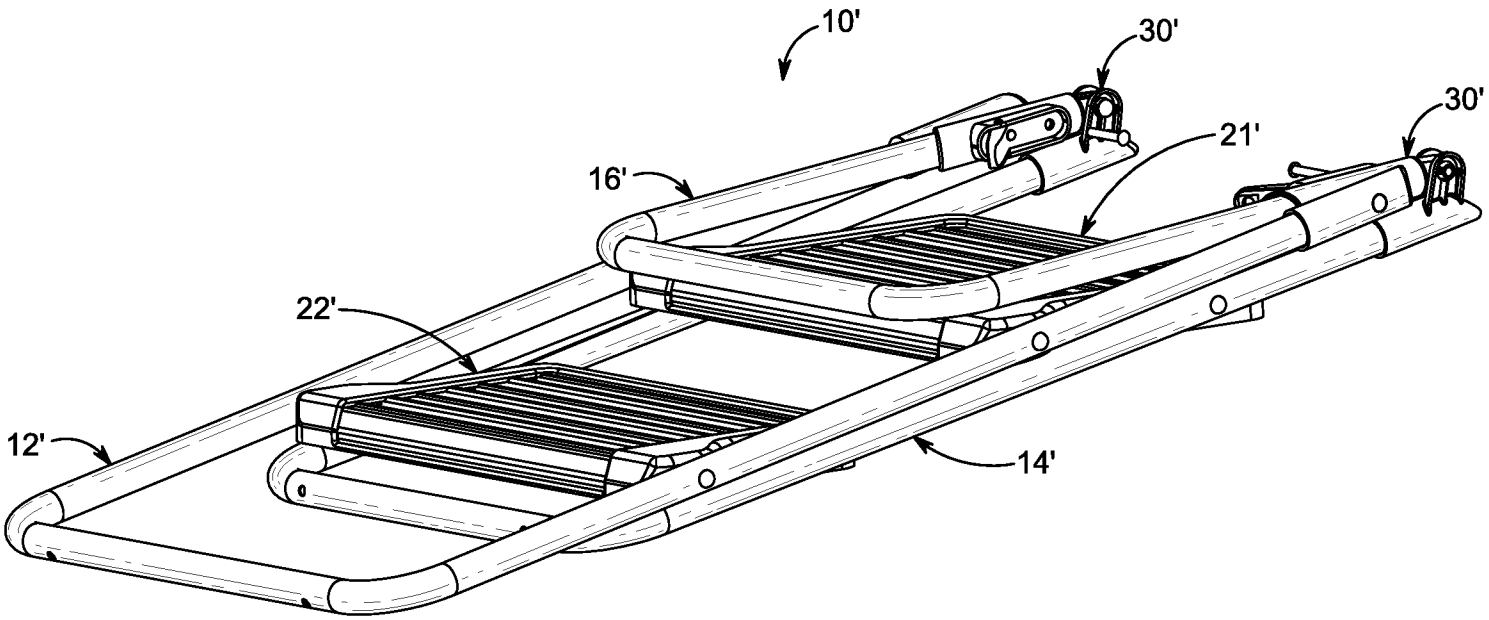
Figure 12:
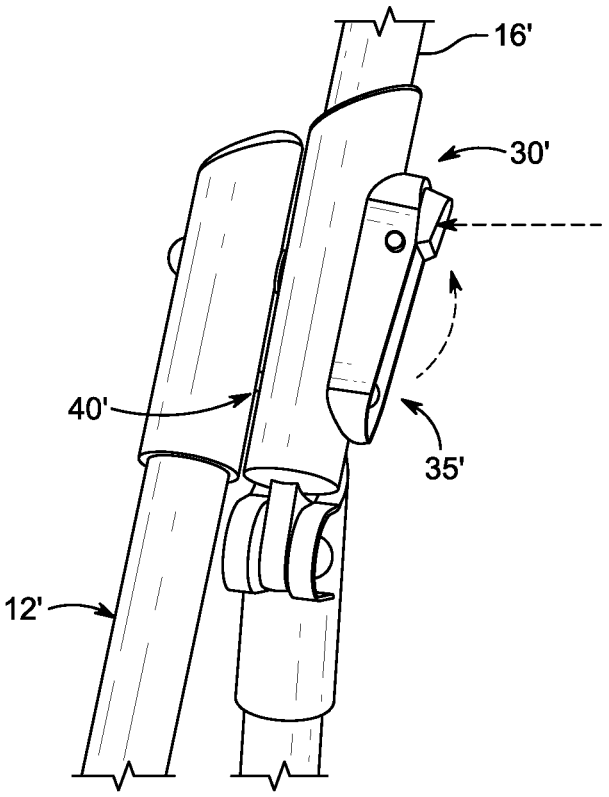
Figure 13:
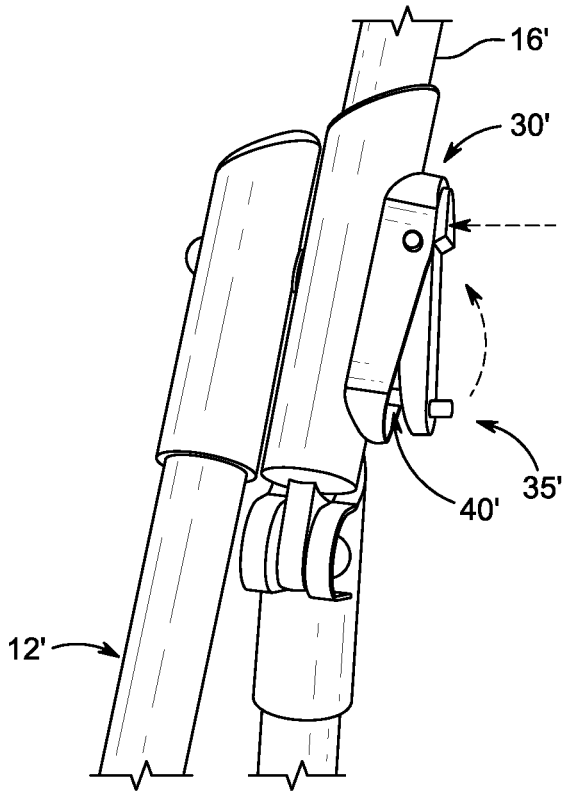

FIG. 7C is an enlarged perspective view showing pivotable engagement of an upper portion of a first rear leg included in the step unit and a lower portion of the first side rail of the pivotable handrail and showing a pin included in the first rear-leg lock unit that is mounted on the first side rail of the pivotable handrail after the pin has been withdrawn from a pin-receiver aperture formed in the upper portion of the first rear leg;

FIG. 8A is a detail perspective view of one of the rear-leg lock units handrail pivot-blocker lock included in the foldable stepladder showing rear-leg lock unit engaged with the step unit to retain the foldable stepladder in the expanded use mode;

FIG. 8B is a detail perspective view of the rear-leg lock unit of FIG. 8A showing that the rear-leg lock unit has been disengaged from a rear leg of the step unit to allow mode change of the foldable stepladder between the expanded use mode and the collapsed storage mode;

FIG. 9 is perspective view of another foldable stepladder in an expanded use mode showing that the foldable stepladder includes a step unit, a relatively shorter step-stabilizer frame, and a handrail;

FIG. 10 is a perspective view of the foldable stepladder of FIG. 9 showing the foldable stepladder in an intermediate configuration between the expanded use mode shown in FIG. 9 and a collapsed storage mode shown in FIG. 11;

FIG. 11 is a perspective view of the foldable stepladder of FIGS. 9 and 10 showing the foldable stepladder in the collapsed storage mode;

FIG. 12 is a detail perspective view of the lock unit included in the foldable stepladder of FIGS. 9-11 showing that the lock unit is engaged with the step unit to retain the foldable stepladder in the expanded use mode; and FIG. 13 is a detail perspective view of one of the lock units included in the foldable stepladder of FIGS. 9-11 showing the lock unit pivoted about an axis to be disengaged from the step unit to allow mode change of the foldable stepladder between the expanded use mode and the collapsed storage mode.

DETAILED DESCRIPTION

Figure 1:
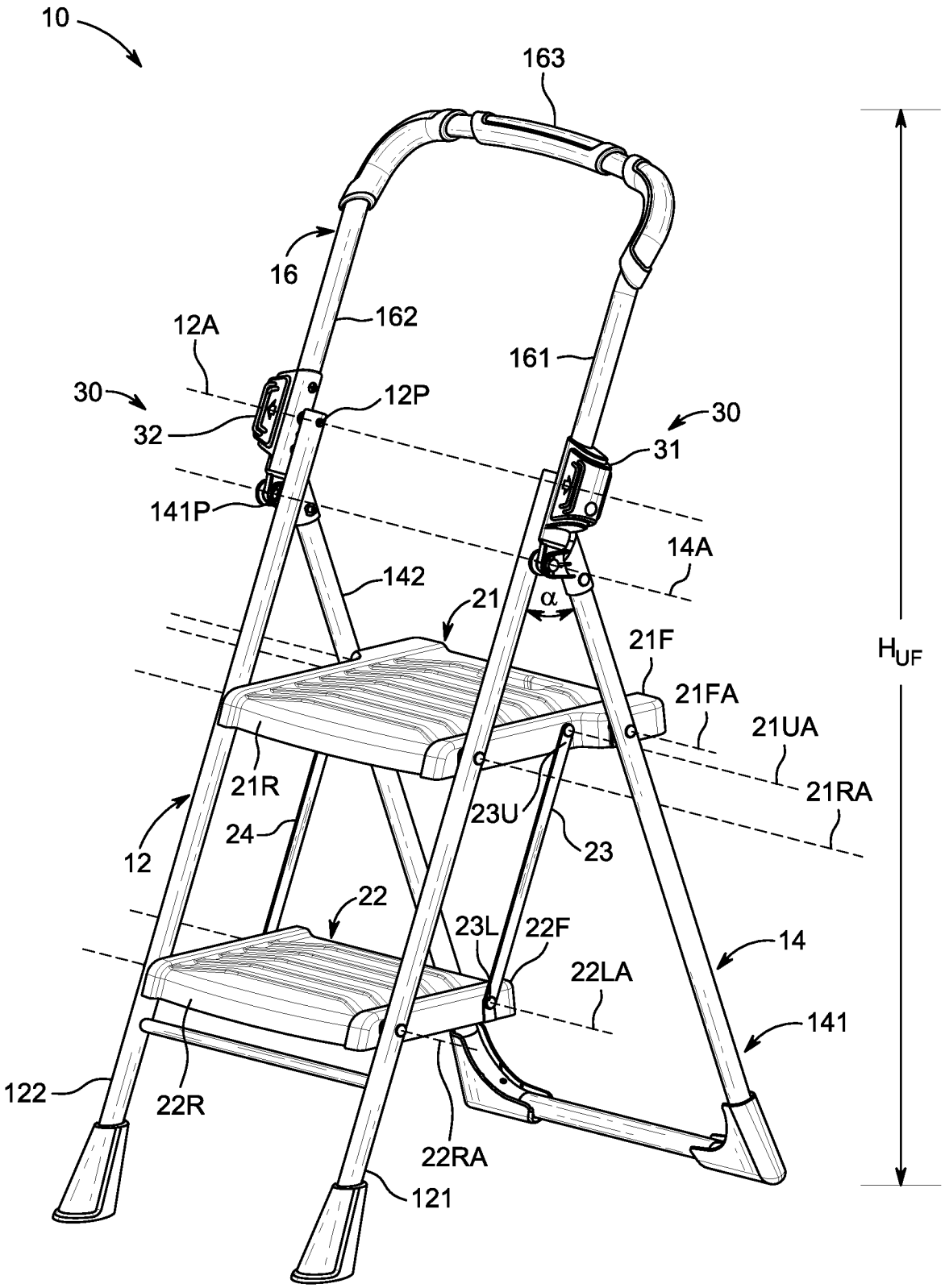
Figure 6:
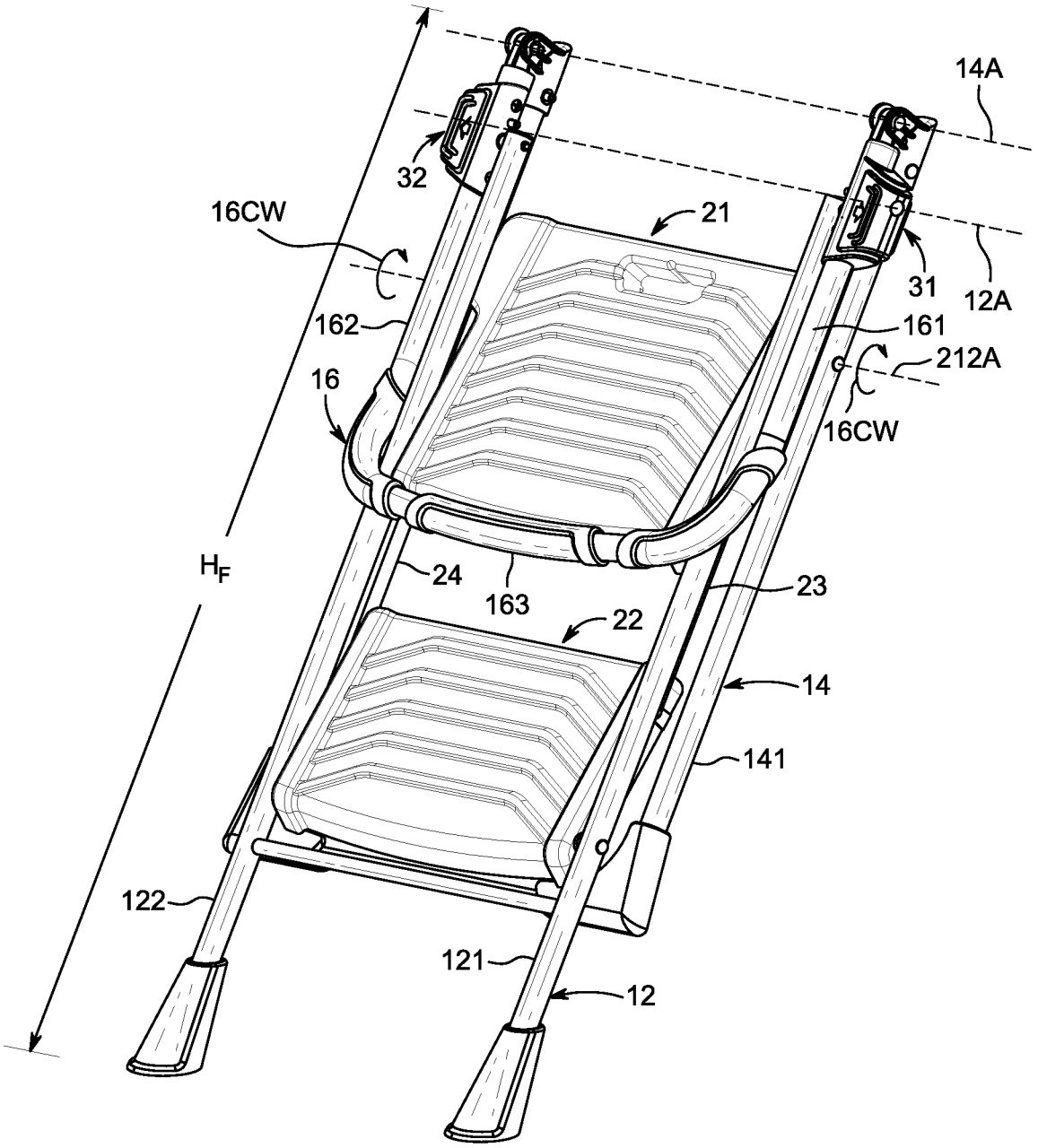

A foldable stepladder 10 according to the present disclosure includes a pivotable handrail 16 that drives motion of components included in foldable stepladder 10 to change the configuration of foldable stepladder 10 from an expanded use (unfolded) mode, shown in FIG. 1, to a collapsed storage (folded) mode, shown in FIG. 6. In the expanded use (unfolded) mode, handrail 16 extends upwardly away from a step unit 12 that is stabilized by a step-stabilizer frame 14 to provide a grip handle 163 for use by a user standing on one of the steps included in step unit 12 as suggested in FIG. 1. In the collapsed storage mode, handrail 16 is stored to lie alongside a rear side of step unit 12 while step-stabilizer frame 14 is stored to lie alongside an opposite front side of step unit 12 so as to reduce the overall storage height of foldable stepladder 10 as suggested in FIG. 6.

A lock system 30 is included in the foldable stepladder 10 and is adapted to retain the stepladder 10 in the expanded use mode as suggested in FIG. 7. Lock system 30 can be operated by a user to free the stepladder 10 for reconfiguration as suggested in FIGS. 8A and 8B.

Figure 2:
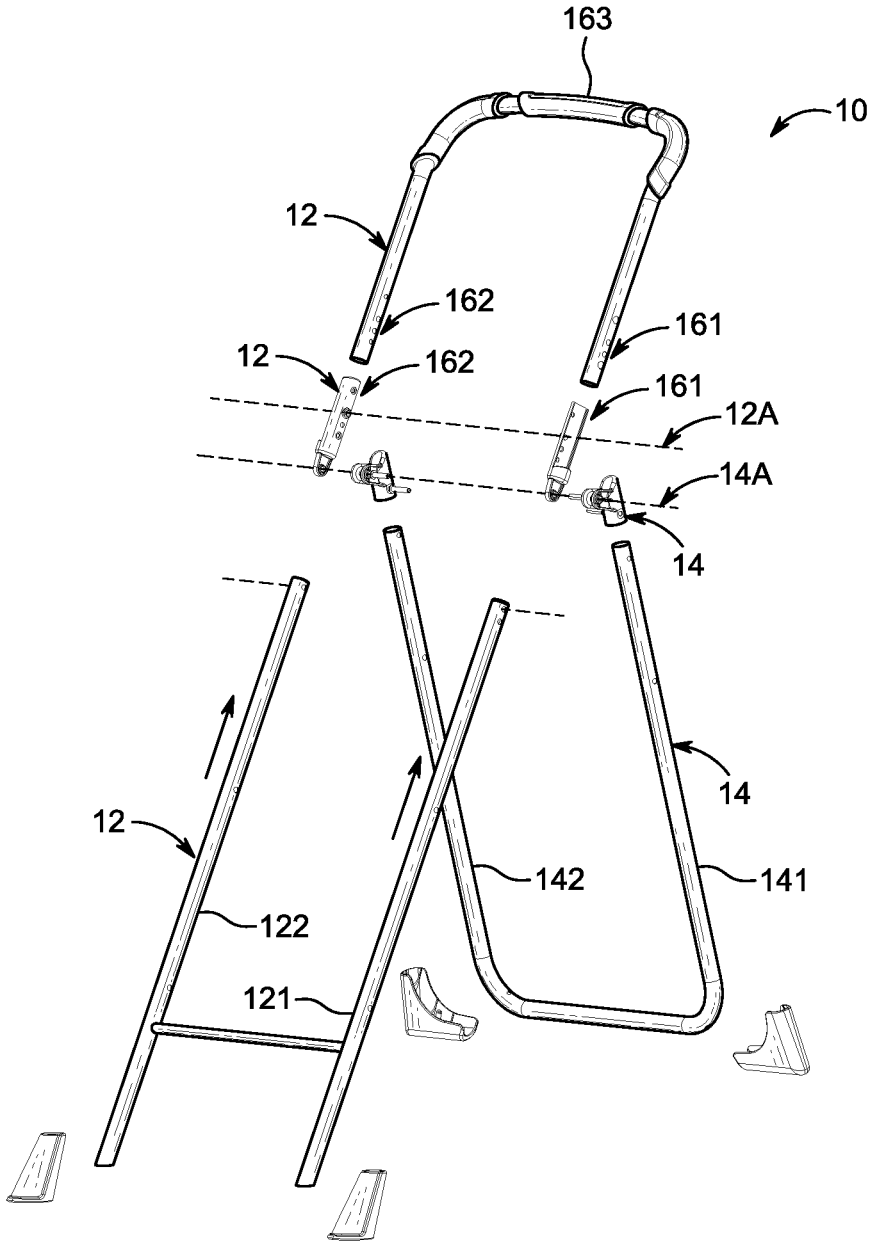
FIG. 2 is an exploded perspective assembly view of certain components included in the foldable stepladder.
Figure 2A:
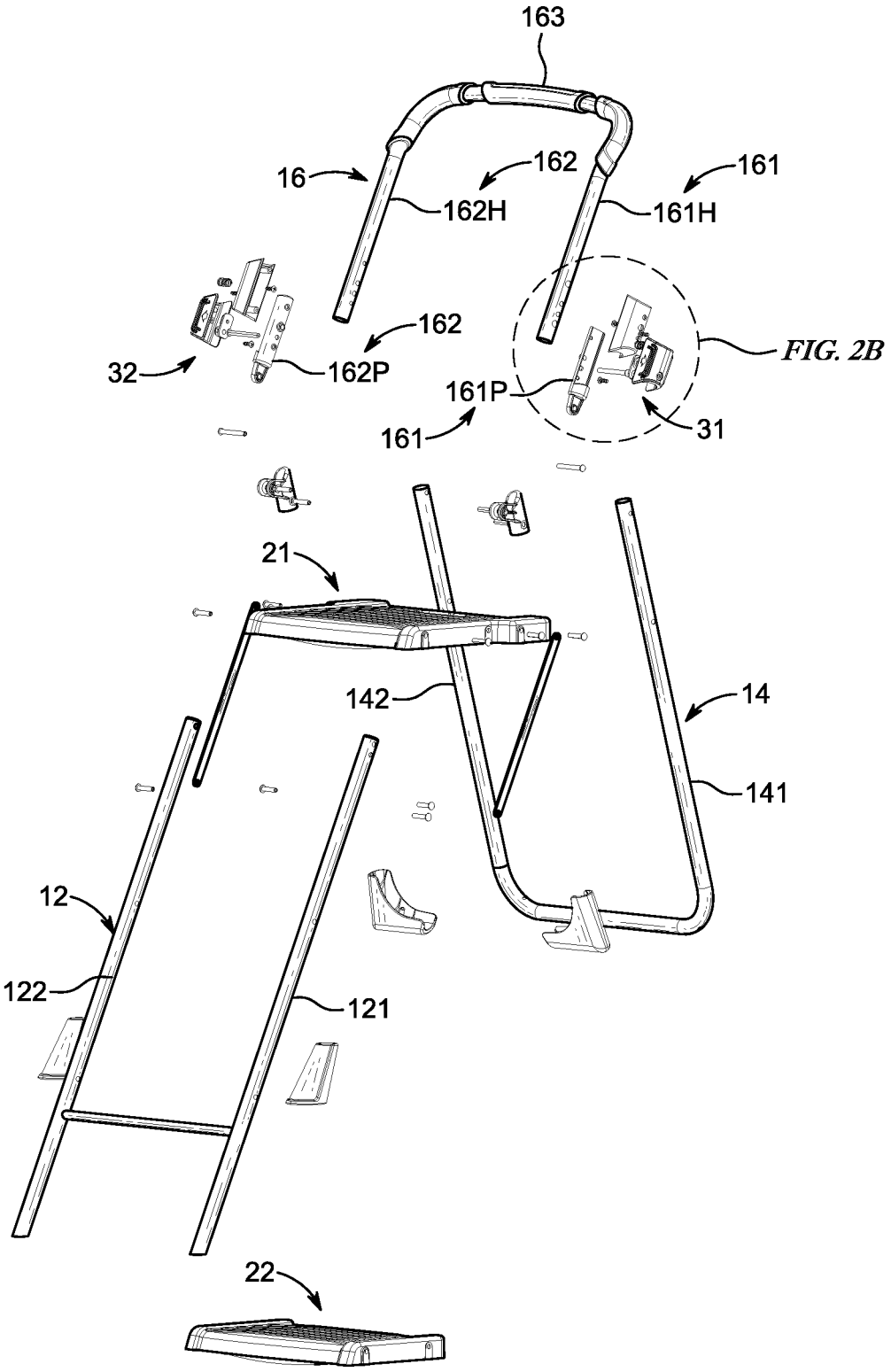
FIG. 2A is an exploded perspective assembly view of the foldable stepladder of FIG. 1.
Figure 2B:
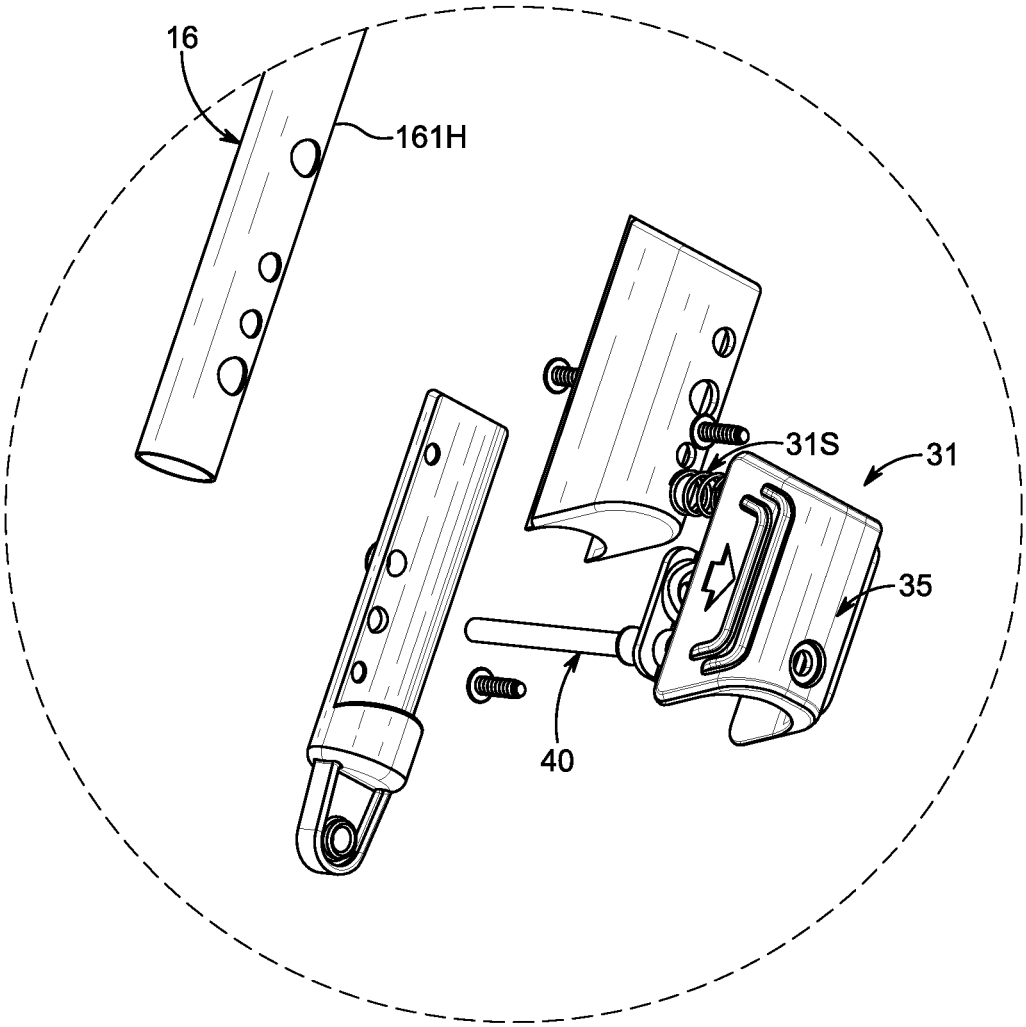
FIG. 2B is a detail view of a portion of FIG. 2A showing components of a rear-leg lock unit adapted to engage a rear leg included in the step unit to retain the foldable stepladder in the expanded use mode.

Foldable stepladder 10 includes a step unit 12 comprising steps 21, 22, a relatively shorter pivotable step-stabilizer frame 14, and a pivotable handrail 16 including a grip handle 163 as suggested in FIGS. 1 and 2. Handrail 16 is pivotably coupled (1) to rear legs 121, 122 of step unit 12 at a rear-leg handrail pivot axis 12A and (2) to front legs 141, 142 of step-stabilizer frame 14 at a front-leg handrail pivot axis 14A as suggested in FIGS. 1 and 2.

An upper step 21 of step unit 12 is pivotably coupled to first and second rear legs 121, 122 of step unit 12 at a rearward upper-step pivot axis 21RA and to first and second front legs 141, 142 of step-stabilizer frame 14 at a forward upper-step pivot axis 21RA as shown in FIG. 1. A lower step 22 of step unit 12 is pivotably coupled to first and second rear legs 121, 122 of step unit 12 at a rearward lower-step pivot axis 22RA as also shown in FIG. 1. It is within the scope of this disclosure to include more than one step like lower step 22 in step unit 12.

Step-support links 23, 24 are included in step unit 12 to cause upper and lower steps 21, 22 to remain in parallel relation to one another as steps 21, 22 pivot about pivot axes 21RA, 22RA during folding and unfolding of foldable stepladder 10 as suggested in FIGS. 1 and 3-6. First step-support link 23 has a lower end 23L that is pivotably coupled to a forward portion 22F of lower step 22 at a forward lower-end link pivot axis 22LA and an upper end 23U that is pivotably coupled to a forward portion 21F of upper step 21 at a forward upper-end link pivot axis 21UA. Second step-support link 24 is arranged to lie in spaced-apart parallel relation to first step-support link 23 as shown in FIG. 1. Second step-support link 24 has a lower end 24L that is pivotably coupled to forward portion 22F of lower step 22 at forward lower-end limit pivot axis 22LA and an upper end 24U that is pivotably coupled to forward portion 21F of upper step 21 at forward upper-end link pivot axis 21UA.

Figure 3:
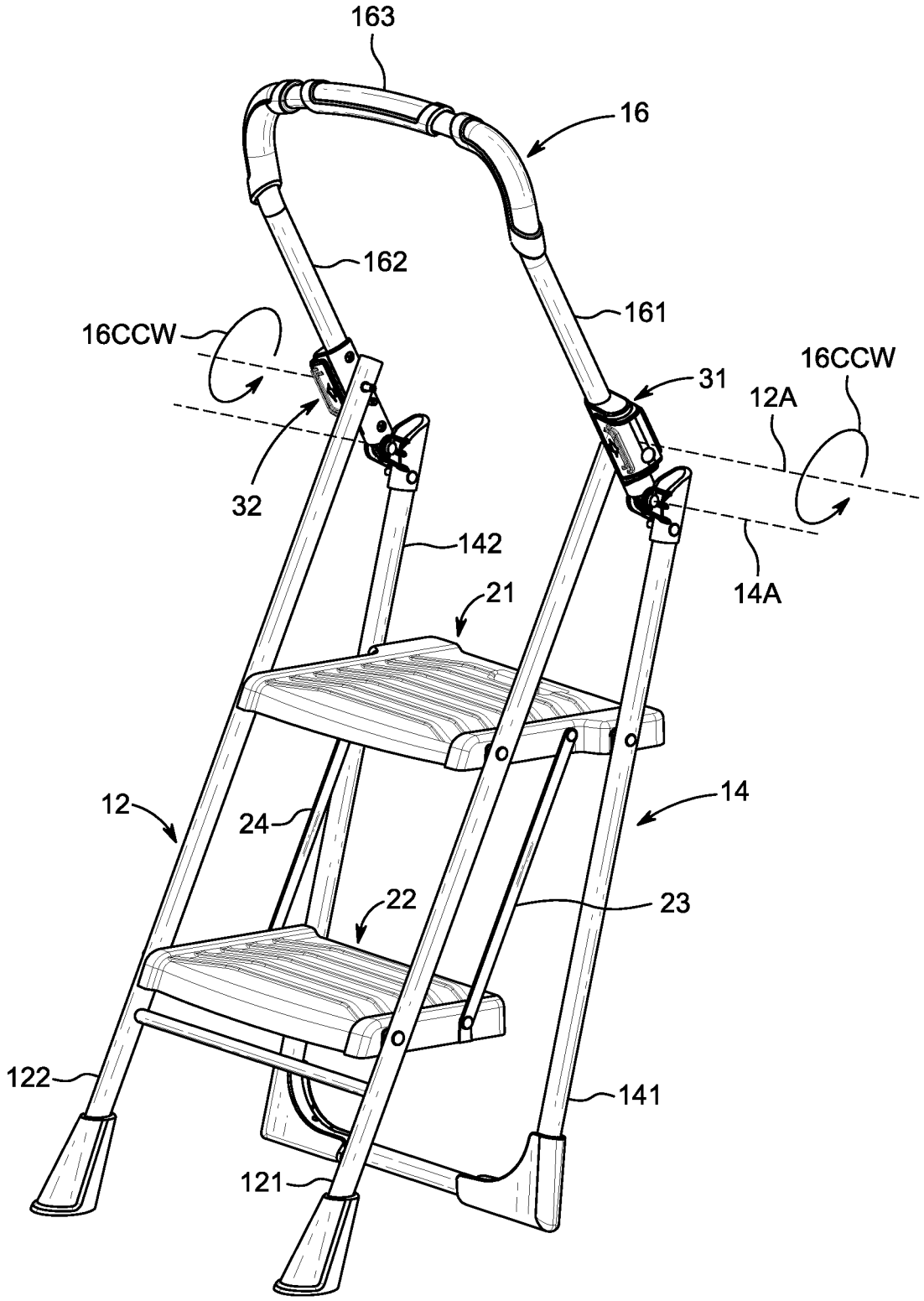
FIGS. 3-6 are perspective views of the foldable stepladder of FIG. 1 showing various configurations of the foldable stepladder during folding of the stepladder as it is converted from the expanded use mode shown in FIG. 1 to the collapsed storage mode shown in FIG. 6.
Figure 4:
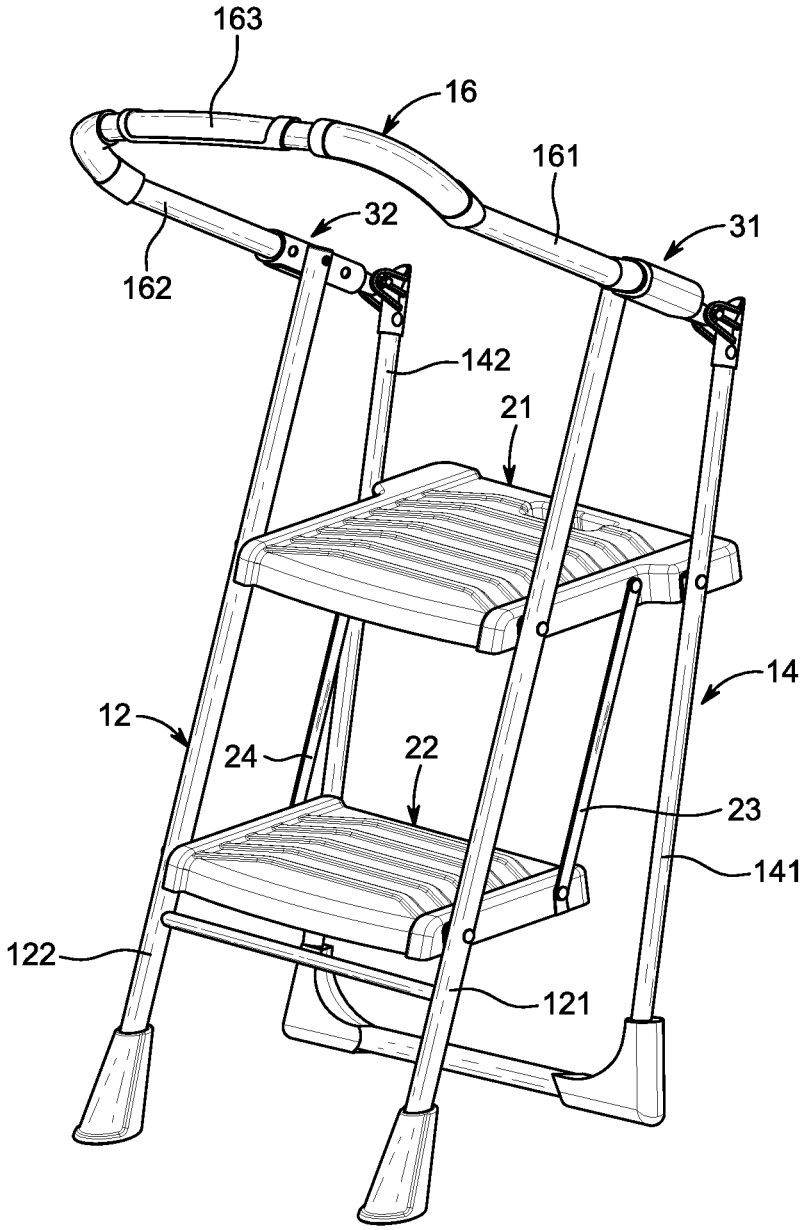

To initiate folding of stepladder 10, pivotable handrail 16 is pivoted rearwardly relative to step unit 12 about rear-leg handrail pivot axis 12A in a counterclockwise direction 16CCW after lock system 30 is unlocked as suggested in FIG. 3. Such rearward pivoting motion of handrail 16 is continued as suggested in FIGS. 4-6 until handrail 16 lies along a rearward-facing portion of step unit 12 as shown, for example, in FIG. 6. Pivotable step-stabilizer frame 14 simultaneously is pivoted toward a forward-facing portion of step unit 12 as also suggested in FIGS. 3-6 owing to the pivotable coupling of the front legs 141, 142 of step-stabilizer frame 14 (1) to handrail 16 at front-leg handrail pivot axis 14A and (2) to upper step 21 of step unit 12 at forward upper-step pivot axis 21FA. During such folding of stepladder 10, upper and lower steps 21, 22 are pivoted on pivot axes 21RA, 22RA from the horizontally extending positions shown in FIG. 1 to the steeply inclined positions shown in FIG. 6. Stepladder 10 has a folded height $H_F$ that is shown in FIG. 6 and that is less than an unfolded height $H_{UF}$ of stepladder 10 that is shown in FIG. 1.

Figure 5:
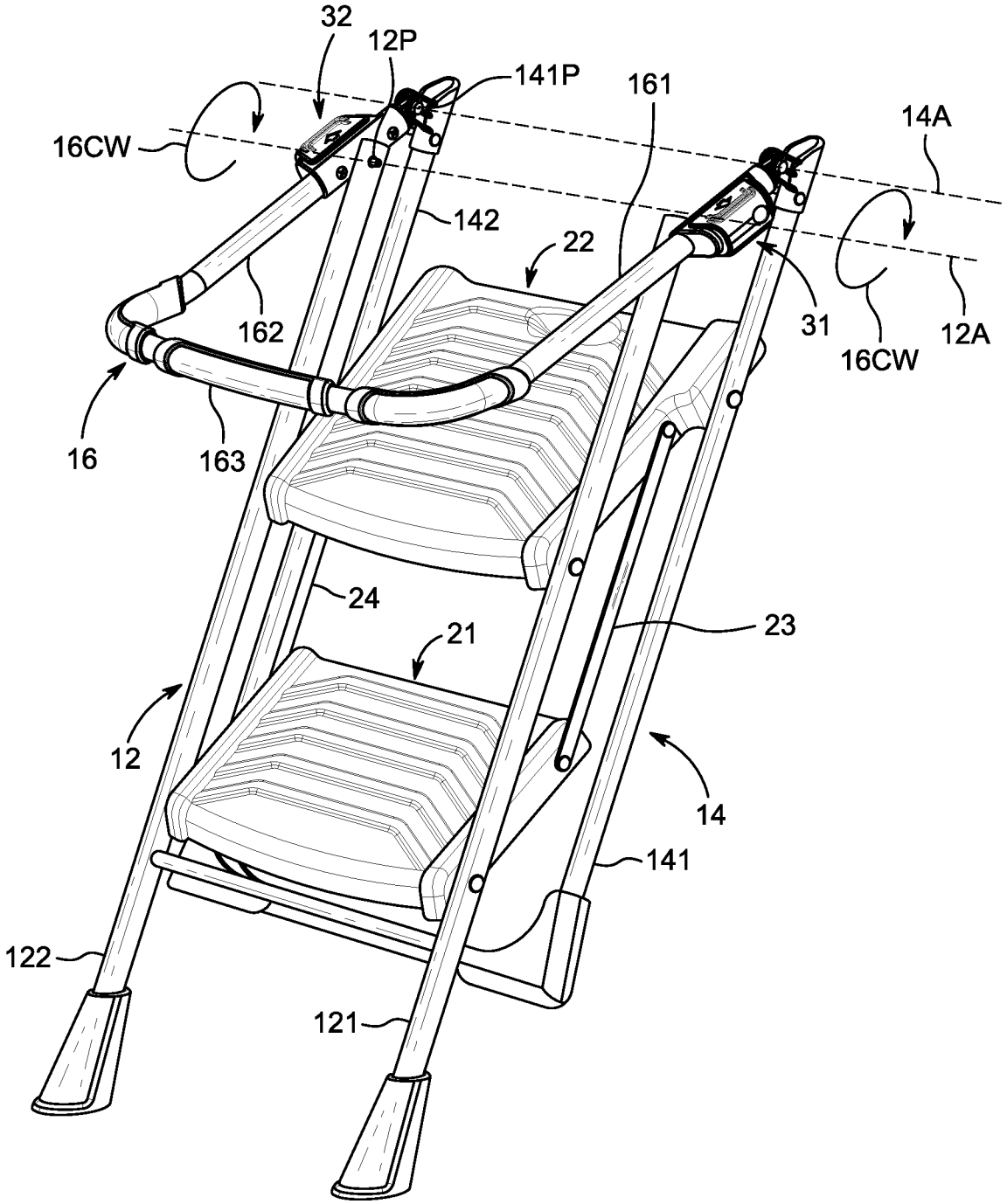

To initiate unfolding of stepladder 10, the sequence shown in FIGS. 1 and 3-6 is reversed by pivoting handrail 16 about rear-leg handrail pivot axis 12A in a clockwise direction 16CW as suggested in FIGS. 5 and 6 upwardly relative to step unit 12 as shown in FIG. 5. Such upward pivoting motion of handrail 16 causes pivotable step-stabilizer frame 14 to more forwardly away from step unit 12 as suggested in FIG. 5 owing to the pivotable coupling of front legs 141, 142 of step-stabilizer frame 14 (1) to handrail 16 at front-leg handrail pivot axis 14A and (2) to upper step 21 of step unit 21 of step unit 12 at forward upper-step pivot axis 21FA. During such unfolding of stepladder 10, upper and lower steps 21, 22 are pivoted on pivot axes 21RA, 22RA from the steeply inclined positions shown in FIG. 6 to the horizontally extending positions shown in FIG. 1.

In illustrative embodiments, pivotable handrail 16 is a U-shaped element comprising first and second side rails 161, 162 and a grip handle 163 interconnecting handle ends (H) of each of the first and second side rails 161, 162 as suggested in FIG. 1. Each side rail 161, 162 also includes an opposing pivot end (P) coupled to the pivotable step-stabilizer frame 14 at the front-leg handrail pivot axis 14A. Each side rail 161, 162 includes a medial portion (M) located between the handle and pivot ends (H, P) and step unit 12 is pivotably coupled to the medial portions (M) of pivotable handrail 16 at rear-leg handrail pivot axis 12A. As suggested in FIGS. 1 and 2, rear-leg handrail pivot axis 12A is arranged to lie between front-leg handrail pivot axis 14A and grip handle 163.

In illustrative embodiments, a rear-leg lock system 30 comprising first and second rear-leg locks 31, 32 is mounted on handrail 16 to pivot therewith during movement of handrail 16 relative to step-stabilizer frame 14 and step unit 12 as shown in FIGS. 3-6. For example, first rear-leg lock 31 is configured to lock first side rail 161 of handrail 16 to first rear leg 121 of step unit 12 when foldable stepladder 10 is in an expanded use (unfolded) mode shown in FIG. 1 to block change of foldable stepladder 10 to a collapsed storage (folded) mode shown in FIG. 6. In the expanded use (unfolded) mode, an anti-rotation element (pin) 40 included in rear-leg lock 31 is arranged to engage both of handrail 16 and step unit 12 to block rotation of handrail 16 about front-rail handrail pivot axis 14A relative to step-stabilizer frame 14. This also blocks rotation of handrail 16 relative to step-stabilizer frame 14. When an operator actuates first rear-leg lock unit 31 by sliding an actuator 35 outwardly, the anti-rotation element 40 is withdrawn from a pin-receiver aperture 41 found in first rear leg 121 to disengage first rear leg 121 of step unit 12 to free handrail 16 to pivot about front-leg handrail pivot axis 14A so that step unit 12 is free to pivot relative to handrail 16 about rear-leg handrail pivot axis 12A as suggested in FIGS. 3-6. In the illustrative embodiment, the rear-leg lock unit 31 is biased toward the locked position by a spring 31.

A foldable stepladder 10 includes a step unit 12, a step-stabilizer frame 14, and a pivotable handrail 16 as suggested in FIG. 1. The pivotable handrail 16 can be pivoted relative to step unit 12 and step-stabilizer frame 14 to move step unit 12 and step-stabilizer frame 14 relative to one another to change the foldable stepladder 10 from an expanded use (unfolded) mode shown in FIG. 1 to a collapsed storage (folded) mode shown in FIG. 6 and vice versa.

Step unit 12 includes laterally spaced-apart first and second rear legs 121, 122, an upper step 21, and a lower step 22 as shown in FIG. 1. Upper step 21 has a rearward portion 21R pivotably coupled to a middle portion of each of the first and second rear legs 121, 122 at a rearward upper-step pivot axis 21RA and also has an opposite forward portion 21F. Lower step 22 has a rearward portion 22R pivotably coupled to a lower portion of each of the first and second rear legs 121, 122 at a rearward lower-step pivot axis 22RA and also has an opposite forward portion 22F.

Step unit 12 further includes first and second step-support links 23, 24 as shown in FIG. 1. First step-support link 23 has a lower end 23L pivotably coupled to a first side of the opposite forward portion 22F of lower step 22 at a forward lower-end link pivot axis 22LA and an upper end 23U pivotably coupled to a first side of the opposite forward portion 21F of upper step 21 at a forward upper-end link pivot axis 21UA. Second step-support link 24 has a lower end 24L pivotably coupled to a second side of the opposite forward portion 22F of lower step 22 at the forward lower-end link pivot axis 22LA and an upper end 24U pivotably coupled to a second side of the opposite forward portion 21F of upper step 21 at the forward upper-end link pivot axis 21UA.

Step-stabilizer frame 14 includes laterally spaced-apart first and second front legs 141, 142 as shown in FIGS. 1 and 2. Each of the first and second front legs 141, 142 has an upper portion and a middle portion arranged to lie below the upper portion of the first and second front legs 141, 142. The middle portion of each front leg 141, 142 is pivotably coupled to the opposite forward portion of upper step 21 at a forward upper-step pivot axis 21FA as suggested in FIG. 1.

The pivotable handrail 16 is coupled to the upper portions of the first and second rear legs 121, 122 of step unit 12 for pivotable movement relative to the first and second rear legs 121, 122 about a rear-leg handrail pivot axis 12A as suggested in FIG. 1. Pivotable handrail 16 is also coupled to the upper portions of the first and second front legs 141, 142 of step-stabilizer frame 14 for pivotable movement relative to the first and second front legs 141, 142 about a front-leg handrail pivot axis 14A. The pivotable handrail 16 is configured to provide mode-changer means for changing the foldable stepladder 10 from (1) an expanded use (unfolded) mode in which the front and rear legs are spread apart to form an acute included angle $\alpha$ between each of the first front and rear legs 121, 141 and between each of the second front and rear legs 121, 141 and in which the upper and lower upper steps 21, 22 are arranged to extend horizontally to lie in spaced-apart parallel relation to one another to (2) a collapsed storage (folded) mode in which the first rear and front legs 121, 141 are arranged to lie in spaced-apart parallel relation to one another, the second rear and front legs 122, 142 are arranged to lie in spaced-apart parallel relation to one another, and the upper and lower steps 21, 22 are retained in positively sloping directions relative to the first rear and front legs 121, 141 in response to pivoting movement of the pivotable handrail 16 about the rear-leg handrail pivot axis 12A in a counterclockwise direction 16CCW toward the first and second rear legs 121, 122 so as to cause simultaneous pivoting movement of step-stabilizer frame 14 about the front-leg handrail pivot axis 14A in a clockwise direction 16CW toward the first and second front legs 141, 142.

The front-leg handrail pivot axis 14A is arranged to lie in spaced-apart relation to the first and second rear legs 121, 122 when the foldable stepladder 10 is in the collapsed storage (folded) mode as shown in FIG. 6. The front-leg handrail pivot axis 14A is also arranged to intersect each of the first and second rear legs 121, 122 when the foldable stepladder 10 is in the expanded use (unfolded) mode as shown in FIG. 1.

Step-stabilizer frame 14 further includes a first handrail pivot mount 141M, a first handrail support 141H, and a first pivot axle 141P as shown, for example, in FIGS. 7A-7C. First handrail pivot mount 141M includes a first front-leg cap 141C coupled to a top end of the upper portion of first front leg 141 of step-stabilizer frame 14. First handrail support 141H is cantilevered to first front-leg cap 141C and arranged to extend away from the top end of the upper portion of first front leg 141 of step-stabilizer frame 14. First pivot axle 141P is arranged to extend along the front-leg handrail pivot axis 14A. First pivot axle 141P is coupled to each of the first handrail 141H support and the pivotable handrail 16 as suggested in FIGS. 7A and 7B to support the pivotable handrail 16 for pivotable movement relative to first handrail support 141H about the front-leg handrail pivot axis 14A during a stepladder mode change in which the foldable stepladder 10 changes from the expanded use (unfolded) mode to the collapsed storage (folded) mode.

The pivotable handrail 16 includes a horizontally extending grip handle 162 and a first side rail 161 as suggested in FIG. 1. First side rail 161 has a handle-end section 161H coupled to the horizontally extending grip handle 163 as suggested in FIG. 1 and an opposite pivot-end section 161P coupled to the first pivot axle 141P of the first handrail pivot mount 141M at the front-leg handrail pivot axis 14A as suggested in FIG. 7A. The opposite pivot-end section 161P of the first side rail 161 is arranged to lie in laterally spaced-apart parallel relation to the upper portion of first rear leg 121 when the foldable stepladder 10 is in the collapsed storage (folded) mode as suggested in FIG. 6.

The pivotable handrail 16 further includes a second side rail 162 having a handle-end section 162H and an opposite pivot-end section 162P as shown, for example, in FIGS. 1 and 7A. Handle-end section 162H is coupled to the horizontally extending grip handle 163 and arranged to lie in spaced-apart relation to handle-end section 161H of first side rail 161. The opposite pivot-end section 162P of second side rail is coupled to step-stabilizer frame 14 for pivotable movement about front-leg handrail pivot axis 14A. Upper portions of the first and second rear legs 121, 122 of step unit 12 are arranged to lie between the opposite pivot-end sections 161P, 162P of first and second side rails 161, 162 of the pivotable handrail 16 when foldable stepladder 10 is in the collapsed storage (folded) mode as suggested in FIG. 6. The rear-leg handrail pivot axis 12A is arranged to lie between grip handle 163 and front-leg handrail pivot axis 14A when the foldable stepladder 10 is in each of the expanded use and collapsed storage modes.

Step-stabilizer frame 14 further includes a second handrail pivot mount 142M, a second handrail support 142 *h*, and a second pivot axle 142P as suggested in FIG. 7A. Second handrail pivot mount 142M includes a second front-leg cap 142C coupled to a top end of the upper portion of second front leg 142 of step-stabilizer frame 14. Second handrail support 142H is cantilevered to second front-leg cap 142C and arranged to extend away from the top end of the upper portion of second front leg 142 of step-stabilizer frame 14. Second pivot axle 142P is arranged to extend along front-leg handrail pivot axis 14A and lie in laterally spaced-apart relation to first pivot axle 141 of first handrail pivot mount 141M. Second pivot axle 142P is coupled to each of second handrail support 142H and the pivotable handrail 16 as suggested in FIG. 7A to support the pivotable handrail 16 for pivotable movement relative to second handrail support 142H about front-leg handrail pivot axis 14A during a stepladder mode change in which the foldable stepladder 10 changes from the expanded use (unfolded) mode to the collapsed storage (folded) mode.

First front leg cap 141C is formed to include a motion-blocker surface 141CB that is shown in FIG. 7A and is arranged to engage the opposite pivot-end section 161P of first side rail 161 of the pivotable handrail 16 as suggested in FIG. 1 to block pivotable movement of first side rail 161 of the pivotable handrail 16 relative to first front leg 141 of step-stabilizer 14 frame about rear-leg handrail pivot axis 12A only when the foldable stepladder 10 is in the expanded use (unfolded) mode without blocking pivotable movement of first side rail 161 of the pivotable handrail 16 away from first front leg 141 of step-stabilizer frame 14 during a change of the foldable stepladder 10 from the expanded use (unfolded) mode to the collapsed storage mode as suggested in FIGS. 3-6. The opposite pivot-end section 161P of first side rail 161 of the pivotable handrail 16 includes an axle connector 161P1 and a convex member 161P2 as suggested in FIG. 7C. Axle connector 161P1 is coupled to first pivot axle 141P. Convex member 161P2 is arranged to lie between axle connector 161P1 and the horizontally extending hand grip 163. Motion-blocker surface 141CB of first front leg cap 141C has a concave shape as suggested in FIGS. 7A and 7B that is sized to receive and mate with convex member 161P2 of the opposite pivot-end section 161P of first side rail 161 therein as suggested in FIG. 1 when the foldable stepladder 10 is in the expanded use (unfolded) mode.

The opposite pivot-end section 161P of first side rail 161 is arranged to extend at various angles to the upper portion of first rear leg 121 during pivoting movement of the pivotable handrail 16 to change the foldable stepladder 10 from the expanded use (unfolded) mode to the collapsed storage (folded) mode as suggested in FIGS. 3-6. The opposite pivot-end section 161P of first side rail 161 is also arranged to lie in diagonally spaced-apart parallel relation to the upper portion of first front leg 141 when the foldable stepladder 10 is in the collapsed storage (folded) mode as suggested in FIG. 6.

First handrail support 141H includes an outer support arm 141HO and an inner support arm 141HI that is arranged to lie in spaced-apart relation to the outer support arm 141HO to form a connector-receiving space 141S therebetween as suggested in FIG. 7C. First pivot axle 141P is arranged to interconnect the outer and inner support arms 141HO, 141HI to span the connector-receiving space 141S. The opposite pivot-end section 161P of the first side rail 161 includes an axle connector 16P1 arranged to extend into the connector-receiving space 141S and mate in rotative bearing engagement with an exposed portion of first pivot axle 141P located between outer and inner support arms 141HO, 141HI. Front-leg handrail pivot axis 14A is arranged to intersect each of first and second rear legs 121, 122 when the foldable stepladder 10 is in the expanded use (unfolded) mode as suggested in FIG. 1.

Upper step 21 is T-shaped as suggested in FIGS. 1 and 5. Rearward portion 21R of upper step 21 has a first width extending between first and second rear legs 121, 122 and between first and second step-support links 23, 24. The opposite forward portion 21F of upper step 21 has a relatively larger second width extending between first and second front legs 141, 142. Lower step 22 is rectangle-shaped and has a width extending between first and second rear legs 121, 122 and between the first and second step-support links 23, 24 that is equal to the first width.

The foldable stepladder 10 further comprises rear-leg lock means 30 mounted on the pivotable handrail 16 to pivot therewith during movement of the pivotable handrail 16 relative to step unit 12 and to step-stabilizer frame 14 for releasably locking the pivotable handrail 16 to step unit 12 when the foldable stepladder 10 is in the expanded use (unfolded) mode as suggested in FIG. 1. The pivotable handrail 16 includes a first side rail 16 pivotably coupled to first front leg 141, a second side rail 162 pivotably coupled to second front leg 142, and a grip handle 163 arranged to interconnect first and second side rails 161, 162. The rear-leg lock means 30 includes a first lock unit 31 mounted on first side rail 161 and configured to mate with first rear leg 121 when the foldable stepladder 10 is in the expanded use (unfolded) mode and a separate second lock unit 32 mounted on second side rail 162 and configured mate with second rear leg 122 when the foldable stepladder 10 is in the expanded use (unfolded) mode.

Step unit 12 includes laterally spaced-apart first and second rear legs 121, 122, a lower step 22 having a rearward portion 22R pivotably coupled to a lower portion of each of first and second rear legs 121, 122 at a rearward lower-step pivot axis 22RA and an opposite forward portion 22F, and an upper step 21 having a rearward portion 21R pivotably coupled to an upper portion of each of first and second rear legs 121, 122 at a rearward upper-step pivot axis 21RA and an opposite forward portion 21F. Step unit 12 also includes a first step-support link 23 having a lower end 23L pivotably coupled to the opposite forward portion 22F of lower step 22 at a forward lower-end link pivot axis 22LA and an upper end 23L pivotably coupled to the opposite forward portion 21F of upper step 21 at a forward upper-end link pivot axis 21UA. Step unit 12 also includes a second step-support link 24 similar to first step-support link 23 and arranged to lie in spaced-apart parallel relation to first step-support link 23 to locate lower and upper steps 22, 21 therebetween as shown in FIG. 1.

Step-stabilizer frame 14 includes laterally spaced-apart first and second front legs 141, 142 as suggested in FIGS. 1 and 3. Each of first and second front legs 141, 142 has an upper portion and a middle portion that is arranged to lie below upper portion of first and second front legs 141, 142 and is pivotably coupled to the opposite forward portion 21F of upper step 21 at a forward upper-step pivot axis 21RA.

Pivotable handrail 16 is coupled to upper portions of first and second rear legs 121, 122 of step unit 12 by rear-leg pivot axles 12P for pivotable movement relative to first and second rear legs 121, 122 about a rear-leg handrail pivot axis 12A. Pivotable handrail 16 is also coupled to upper portions of first and second front legs 141, 142 of step-stabilizer frame 14 for pivotable movement relative to first and second front legs 141, 142 about a front-leg handrail pivot axis 14A. These pivotable couplings function to support the pivotable handrail 16 to pivot about front-leg handrail pivot axis 14A relative to step-stabilizer frame 14 in a counterclockwise direction 16CCW toward lower portions of first and second rear legs 121, 122 and to pivot each of lower and upper steps 22, 21 in a counterclockwise direction toward upper portions of first and second rear legs 121, 122 so as to change the foldable stepladder 10 from an expanded use (unfolded) mode to a collapsed storage (folded) mode.

In the expanded use (unfolded) mode, the pivotable handrail 16 extends upwardly from front-leg handrail pivot axis 14A and away from upper step 21 to locate a horizontally extending grip handle 163 included in the pivotable handrail 16 at a raised elevation above the forward portion of upper step 21 as suggested in FIG. 1. In the collapsed storage (folded) mode, the pivotable handrail 16 extends downwardly from front-leg handrail pivot axis 14A toward the lower portions of first and second rear legs 121, 122 to locate the horizontally extending grip handle 163 included in the pivotable handrail 16 at a lowered elevation below the forward portion of upper step 21 as suggested in FIG. 6.

The pivotable handrail 16 is a U-shaped element comprising a first side rail 161, the horizontally extending grip handle 163, and a second side rail 162 as suggested in FIG. 1. Each side rail 161, 162 includes a handle-end section 161H, 162H as suggested in FIG. 7A. Handle-end section 161H of first side rail 161 is coupled to a first end of the horizontally extending grip handle 163. The handle-end section 162H of second side rail 162 is coupled to an opposite second end of the horizontally extending grip handle 163. The opposite pivot-end section 161P of first side rail 161 is coupled to upper portion of first front leg 141 at front-leg handrail pivot axis 14A. The opposite pivot-end section 162P of second side rail 162 is coupled to upper portion of second front leg 142 at front-leg handrail pivot axis 14A.

Front-leg handrail pivot axis 14A is arranged to lie between rear-leg handrail pivot axis 12A and the horizontally extending grip handle 163 of the pivotable handrail 16 when the folding stepladder 10 is in the expanded use (unfolded) mode as suggested in FIG. 1. Rear-leg handrail pivot axis 12A is arranged to lie between front-leg handrail pivot axis 14A and the horizontally extending grip handle 163 of the pivotable handrail 16 when the folding stepladder 10 is in the collapsed storage (folded) mode as suggested in FIG. 6.

First rear and front legs 121, 141 are spread apart when the foldable stepladder 10 is in the expanded use (unfolded) mode as suggested in FIG. 1 to define an acute included angle $\alpha$ therebetween to retain the lower and upper steps 22, 21 in horizontally extending directions (1) to position lower step 22 in a horizontal orientation at a first elevation above ground underlying and supporting rear and front legs 121, 141 and (2) to position the upper step 21 in a horizontal orientation at a relatively higher second elevation above the ground underlying and supporting the first rear and front legs 121, 141. First rear and front legs 121, 141 are drawn together to lie in close proximity and in spaced-apart parallel relation to one another to retain the lower and upper steps 22, 21 in positively sloping directions relative to the first rear and front legs 121, 141 when the foldable stepladder 110 is in the collapsed storage (folded) mode as suggested in FIG. 6 and the first rear and front legs 121, 141 are arranged to extend in vertical directions relative to ground underlying the foldable stepladder 10.

Another embodiment of a foldable stepladder 10' is shown in FIGS. 9-13. Foldable stepladder 10' is substantially similar to foldable stepladder 10 shown in FIGS. 1-8B and described herein. Accordingly, similar reference numbers in the prime (') series indicate features that are common between foldable stepladder 10 and foldable stepladder 10'. The description of foldable stepladder 10 is incorporated by reference to apply to foldable stepladder 10', except in instances when it conflicts with the specific description and the drawings of foldable stepladder 10'.

Unlike foldable stepladder 10, foldable stepladder 10' includes lock units 30' that pivot rather than slide as suggested in FIGS. 12 and 13. Lock unit 30' is mounted on handrail 16' to pivot therewith during movement of handrail 16' relative to stabilizer frame 14' and step frame 12'. Lock unit 30' is configured to lock handrail 16' to step frame 12' when stepladder 10' is in an expanded use mode shown in FIG. 9 to block change of stepladder 10' to a collapsed storage mode shown in FIG. 11. In the expanded use mode, an anti-rotation element (pin) 40' included in lock unit 30' is arranged to engage both of handrail 16' and step frame 12' to block rotation of handrail 16'. This also blocks rotation of handrail 16' relative to stabilizer frame 14'. When an operator actuates lock unit 30' by pressing an actuator 35', the anti-rotation element 40' is moved to disengage step frame 12' to free handrail 16' to pivot. In the illustrative embodiment, the lock unit 30' is biased toward the locked position by a spring (not shown).

The invention claimed is:

1. A foldable stepladder comprises a step unit including laterally spaced-apart first and second rear legs, a lower step having a rearward portion pivotably coupled to a lower portion of each of the first and second rear legs at a rearward lower-step pivot axis and an opposite forward portion, an upper step having a rearward portion pivotably coupled to middle portion of each of the first and second rear legs at a rearward upper-step pivot axis and an opposite forward portion, and a first step-support link having a lower end pivotably coupled to the opposite forward portion of the lower step at a forward lower-end link pivot axis and an upper end pivotably coupled to the opposite forward portion of the upper step at a forward upper-end link pivot axis, a step-stabilizer frame including laterally spaced-apart first and second front legs, each of the first and second front legs having an upper portion and a middle portion arranged to lie below the upper portion of the first and second front legs and pivotably coupled to the opposite forward portion of the upper step at a forward upper-step pivot axis, and a pivotable handrail coupled directly to the upper portions of the first and second rear legs of the step unit by a rear-leg pivot axle for pivotable movement relative to the first and second rear legs about a rear-leg handrail pivot axis that is fixed relative to the pivotable handrail and the first and second rear legs and coupled to the upper portions of the first and second front legs of the step-stabilizer frame for pivotable movement relative to the first and second front legs about a front-leg handrail pivot axis that is fixed relative to the pivotable handrail and the first and second front legs to provide mode-changer means for changing the foldable stepladder from an expanded use mode in which the front and rear legs are spread apart to form an acute included angle between each of the first front and rear legs and between each of the second front and rear legs and in which the lower and upper steps extend horizontally to lie in spaced-apart parallel relation to one another to a collapsed storage mode in which the first rear and front legs are arranged to lie in spaced-apart parallel relation to one another, the second rear and front legs are arranged to lie in spaced-apart parallel relation to one another, and the lower and upper steps are retained in positively sloping directions relative to the first rear and front legs in response to pivoting movement of the pivotable handrail about the rear-leg handrail pivot axis in a counterclockwise direction toward the first and second rear legs so as to cause simultaneous pivoting movement of the step-stabilizer frame about the front-leg handrail pivot axis in a clockwise direction toward the first and second front legs.

2. The foldable step ladder of claim 1, wherein the front-leg handrail pivot axis is arranged to lie in spaced-apart relation to the first and second rear legs when the foldable stepladder is in the collapsed storage mode and to intersect each of the first and second rear legs when the foldable stepladder is in the expanded use mode.

3. The foldable step ladder of claim 1, wherein the step-stabilizer frame further includes a first handrail pivot mount including a first front-leg cap coupled to a top end of the upper portion of the first front leg, a first handrail support cantilevered to the first front-leg cap and arranged to extend away from the top end of the upper portion of the first front leg, and a first pivot axle arranged to extend along the front-leg handrail pivot axis and coupled to each of the first handrail support and the pivotable handrail to support the pivotable handrail for pivotable movement relative to the first handrail support about the front-leg handrail pivot axis during a stepladder mode change in which the foldable stepladder changes from the expanded use mode to the collapsed storage mode.

4. The foldable stepladder of claim 3, wherein the pivotable handrail includes a horizontally extending grip handle and a first side rail having a handle-end section coupled to the horizontally extending grip handle and an opposite pivot-end section coupled to the first pivot axle of the first handrail pivot mount at the front-leg handrail pivot axis, and the opposite pivot-end section of the first side rail is arranged to lie in laterally spaced-apart parallel relation to the upper portion of the first rear leg when the foldable stepladder is in the collapsed storage mode.

5. The foldable stepladder of claim 4, wherein the pivotable handrail further includes a second side rail having a handle-end section coupled to the horizontally extending grip handle and arranged to lie in spaced-apart relation to the handle-end section of the first side rail and an opposite pivot-end section coupled to the step-stabilizer frame for pivotable movement about the front-leg handrail pivot axis, and upper portions of the first and second rear legs of the step unit are arranged to lie between the opposite pivot-end sections of the first and second side rails of the pivotable handrail when the foldable stepladder is in the collapsed storage mode.

6. The foldable stepladder of claim 5, wherein the rear-leg handrail pivot axis is arranged to lie between the grip handle and the front-leg handrail pivot axis when the foldable stepladder is in each of the expanded use and collapsed storage modes.

7. The foldable stepladder of claim 5, wherein the step-stabilizer frame further includes a second handrail pivot mount including a second front-leg cap coupled to a top end of the upper portion of the second front leg, a second handrail support cantilevered to the second front-leg cap and arranged to extend away from the top end of the upper portion of the second front leg, and a second pivot axle arranged to extend along the rear-leg handrail pivot axis and lie in laterally spaced-apart relation to the first pivot axle of the first handrail pivot mount, the second pivot axle is coupled to each of the second handrail support and the pivotable handrail to support the pivotable handrail for pivotable movement relative to the second handrail support about the front-leg handrail pivot axis during a stepladder mode change in which the foldable stepladder changes from the expanded use mode to the collapsed storage mode.

8. The foldable stepladder of claim 4, wherein the first front leg cap is formed to include a motion-blocker surface arranged to engage the opposite pivot-end section of the first side rail of the pivotable handrail to block pivotable movement of the first side rail of the pivotable handrail relative to the first front leg of the step-stabilizer frame about the rear-leg handrail pivot axis only when the foldable stepladder is in the expanded use mode without blocking pivotable movement of the first side rail of the pivotable handrail away from the first front leg of the step-stabilizer frame during a change of the foldable stepladder from the expanded use mode to the collapsed storage mode.

9. The foldable stepladder of claim 8, wherein the opposite pivot-end section of the first side rail of the pivotable handrail includes an axle connector coupled to the first pivot axle and a convex member arranged to lie between the axle connector and the horizontally extending hand grip, and the motion-blocker of the first front leg cap has a concave shape sized to receive and mate with the convex member of the opposite pivot-end section of the first side rail therein when the foldable stepladder is in the expanded use mode.

10. The foldable stepladder of claim 4, wherein the opposite pivot-end section of the first side rail is arranged to extend at various angles to the upper portion of the first rear leg during pivoting movement of the pivotable handrail to change the foldable stepladder from the expanded use mode to the collapsed storage mode and to lie in diagonally spaced-apart parallel relation to the upper portion of the first front leg when the foldable stepladder is in the collapsed storage mode.

11. The foldable stepladder of claim 3, wherein the first handrail support includes an outer support arm and an inner support arm that is arranged to lie in spaced-apart relation to the outer support arm to form a connector-receiving space therebetween, the first pivot axle is arranged to interconnect the outer and inner support arms to span the connector-receiving space, and the opposite pivot-end section of the first side rail includes an axle connector arranged to extend into the connector-receiving space and mate in rotative bearing engagement with an exposed portion of the first pivot axle located between the outer and inner support arms.

12. The foldable stepladder of claim 3, wherein the front-leg handrail pivot axis is arranged to intersect each of the first and second rear legs when the foldable stepladder is in the expanded use mode.

13. The foldable stepladder of claim 1, further comprising lock means mounted on the pivotable handrail to pivot therewith during movement of the pivotable handrail relative to the step unit and to the step-stabilizer frame for releasably locking the pivotable handrail to the step unit when the foldable stepladder is in the expanded use mode.

14. The foldable stepladder of claim 13, wherein the pivotable handrail includes a first side rail pivotably coupled to the first front leg, a second side rail pivotably coupled to the second front leg, and a grip handle arranged to interconnect the first and second side rails, and the lock means includes a first lock unit mounted on the first side rail and configured to mate with the first rear leg when the foldable stepladder is in the expanded use mode and a separate second lock unit mounted on the second side rail and configured mate with the second rear leg when the foldable stepladder is in the expanded use mode.

15. A foldable stepladder comprises a step unit including laterally spaced-apart first and second rear legs, a lower step having a rearward portion pivotably coupled to a lower portion of each of the first and second rear legs at a rearward lower-step pivot axis and an opposite forward portion, an upper step having a rearward portion pivotably coupled to a middle portion of each of the first and second rear legs at a rearward upper-step pivot axis and an opposite forward portion, and a first step-support link having a lower end pivotably coupled to the opposite forward portion of the lower step at a forward lower-end link pivot axis and an upper end pivotably coupled to the opposite forward portion of the upper step at a forward upper-end link pivot axis, a step-stabilizer frame including laterally spaced-apart first and second front legs, each of the first and second front legs having an upper portion and a middle portion arranged to lie below the upper portion of the first and second front legs and pivotably coupled to the opposite forward portion of the upper step at a forward upper-step pivot axis, and a pivotable handrail coupled to the upper portions of the first and second rear legs of the step unit for pivotable movement relative to the first and second rear legs about a rear-leg handrail pivot axis and coupled to the upper portions of the first and second front legs of the step-stabilizer frame for pivotable movement relative to the first and second front legs about a front-leg handrail pivot axis to support the pivotable handrail to pivot about the front-leg handrail pivot axis relative to the step-stabilizer frame in a counterclockwise direction toward the lower portions of the first and second rear legs and to pivot each of the lower and upper steps in a counterclockwise direction toward the upper portions of the first and second rear legs so as to change the foldable stepladder from an expanded use mode in which the pivotable handrail extends upwardly from the front-leg handrail pivot axis and away from the upper step to locate a horizontally extending grip handle included in the pivotable handrail at a raised elevation above the forward portion of the upper step and a collapsed storage mode in which the pivotable handrail extends downwardly from the front-leg handrail pivot axis toward the lower portions of the first and second rear legs to locate the horizontally extending grip handle included in the pivotable handrail at a lowered elevation below the forward portion of the upper step, wherein the upper step is T-shaped, the rearward portion of the upper step has a first width extending between the first and second rear legs and between the first and second step-support links, and the opposite forward-portion of the upper step has a relatively larger second width extending between the first and second front legs.

16. The foldable stepladder of claim 15, wherein the lower step is rectangle-shaped and has a width extending between the first and second rear legs and between the first and second step-support links that is equal to the first width.

17. A foldable stepladder comprises a step unit including laterally spaced-apart first and second rear legs, a lower step having a rearward portion pivotably coupled to a lower portion of each of the first and second rear legs at a rearward lower-step pivot axis and an opposite forward portion, an upper step having a rearward portion pivotably coupled to a middle portion of each of the first and second rear legs at a rearward upper-step pivot axis and an opposite forward portion, and a first step-support link having a lower end pivotably coupled to the opposite forward portion of the lower step at a forward lower-end link pivot axis and an upper end pivotably coupled to the opposite forward portion of the upper step at a forward upper-end link pivot axis, a step-stabilizer frame including laterally spaced-apart first and second front legs, each of the first and second front legs having an upper portion and a middle portion arranged to lie below the upper portion of the first and second front legs and pivotably coupled to the opposite forward portion of the upper step at a forward upper-step pivot axis, and a pivotable handrail fixed to the upper portions of the step unit and the step-stabilizer frame, the pivotable handrail coupled to the first and second rear legs of the step unit for pivotable movement relative to the first and second rear legs about a rear-leg handrail pivot axis that is fixed relative to the first and second rear legs and coupled to the upper portions of the first and second front legs of the step-stabilizer frame for pivotable movement relative to the first and second front legs about a front-leg handrail pivot axis that is fixed relative to the first and second front legs and spaced apart from the rear-leg handrail pivot axis along a length of the pivotable handrail to support the pivotable handrail to pivot about the front-leg handrail pivot axis relative to the step-stabilizer frame in a counterclockwise direction toward the lower portions of the first and second rear legs and to pivot each of the lower and upper steps in a counterclockwise direction toward the upper portions of the first and second rear legs so as to change the foldable stepladder from an expanded use mode in which the pivotable handrail extends upwardly from the front-leg handrail pivot axis and away from the upper step to locate a horizontally extending grip handle included in the pivotable handrail at a raised elevation above the forward portion of the upper step and a collapsed storage mode in which the pivotable handrail extends downwardly from the front-leg handrail pivot axis toward the lower portions of the first and second rear legs to locate the horizontally extending grip handle included in the pivotable handrail at a lowered elevation below the forward portion of the upper step.

18. The foldable stepladder of claim 17, wherein the pivotable handrail is a U-shaped element comprising a first side rail, the horizontally extending grip handle, and a second side rail, each side rail includes a handle-end section and an opposite pivot-end section, the handle-end section of the first side rail is coupled to a first end of the horizontally extending grip handle, the handle-end section of the second side rail is coupled to an opposite second end of the horizontally extending grip handle, the opposite pivot-end section of the first side rail is coupled to the upper portion of the first front leg at the front-leg handrail pivot axis, the opposite pivot-end section of the second side rail is coupled to the upper portion of the second front leg at the front-leg handrail pivot axis, and the front-leg handrail pivot axis is arranged to lie between the rear-leg handrail pivot axis and the horizontally extending grip handle of the pivotable handrail when the folding stepladder is in the expanded use mode and the rear-leg handrail pivot axis is arranged to lie between the front-leg handrail pivot axis and the horizontally extending grip handle of the pivotable handrail when the folding stepladder is in the collapsed storage mode.

19. The foldable stepladder of claim 17, wherein the first rear and front legs are spread apart when the foldable stepladder is in the expanded use mode to define an acute included angle therebetween to retain the lower and upper steps in horizontally extending directions to position the lower step in a horizontal orientation at a first elevation above ground underlying and supporting the first rear and front legs and to position the upper step in a horizontal orientation at a relatively higher second elevation above the ground underlying and supporting the first rear and front legs and wherein the first rear and front legs are drawn together to lie in close proximity and in spaced-apart parallel relation to one another to retain the lower and upper steps in positively sloping directions relative to the first rear and front legs when the foldable stepladder is in the collapsed storage mode and the first rear and front legs are arranged to extend in vertical directions relative to ground underlying the foldable stepladder.

20. The foldable stepladder of claim 17, further comprising lock means mounted on the pivotable handrail to pivot therewith during movement of the pivotable handrail relative to the step unit and to the step-stabilizer frame for releasably locking the pivotable handrail to the step unit when the foldable stepladder is in the expanded use mode, and wherein the pivotable handrail includes a first side rail pivotably coupled to the first front leg, a second side rail pivotably coupled to the second front leg, and a grip handle arranged to interconnect the first and second side rails, and the lock means includes a first lock unit mounted on the first side rail and configured to mate with the first front leg when the foldable stepladder is in the expanded use mode and a separate second lock unit mounted on the second side rail and configured mate with the second front leg when the foldable stepladder is in the expanded use mode.

* * * * *